US007884594B2

(12) United States Patent
Rasmus

(10) Patent No.: US 7,884,594 B2
(45) Date of Patent: Feb. 8, 2011

(54) METHOD AND APPARATUS FOR DISTRIBUTION OF A VOLTAGE REFERENCE IN INTEGRATED CIRCUITS

(75) Inventor: Todd M. Rasmus, Cary, NC (US)

(73) Assignee: International Business Machines Corporation, Armonk, NY (US)

( * ) Notice: Subject to any disclaimer, the term of this patent is extended or adjusted under 35 U.S.C. 154(b) by 369 days.

(21) Appl. No.: 12/183,802

(22) Filed: Jul. 31, 2008

(65) Prior Publication Data

US 2010/0026272 A1 Feb. 4, 2010

(51) Int. Cl.
*G05F 3/16* (2006.01)
*G05F 3/20* (2006.01)

(52) U.S. Cl. ..... 323/312; 323/313; 323/314; 323/316

(58) Field of Classification Search ..... 323/312, 323/313, 314, 316
See application file for complete search history.

(56) References Cited

U.S. PATENT DOCUMENTS 7,723,968 B2 * 5/2010 Okuyama et al. ..... 323/274
2002/0075705 A1 * 6/2002 Bayer et al. ..... 363/59
2007/0024378 A1 * 2/2007 Robbe et al. ..... 331/16
2009/0284242 A1 * 11/2009 Motz ..... 323/313
2010/0013448 A1 * 1/2010 Motz ..... 323/280

* cited by examiner

*Primary Examiner*—Bao Q Vu
(74) *Attorney, Agent, or Firm*—Dillon & Yudell LLP

(57) ABSTRACT

Inventive embodiments described here provide for accurately distributing a voltage reference to multiple cores of an integrated circuit (IC). A quasi-differential interface is used to transmit the voltage reference, and a virtual ground is established at a receiver located at each core location on the integrated circuit. In one embodiment, the receiver is an operational transconductance amplifier (OTA) that converts a virtual-ground-referenced voltage input to a current. In one embodiment, the OTA converts the virtual-ground-referenced voltage into three currents via three driving current sources operating relative to the virtual ground and the local ground of the core. Negative feedback controls the accuracy of this conversion and provides a way to cancel the effects of the distribution resistance. The current is sourced across the voltage domains between the virtual ground and the $V_{SS}$, which is the IC ground. An I*R drop across a resistor converts the current to a voltage referenced to $V_{SS}$ at the output.

10 Claims, 2 Drawing Sheets

METHOD AND APPARATUS FOR DISTRIBUTION OF A VOLTAGE REFERENCE IN INTEGRATED CIRCUITS

BACKGROUND

1. Technical Field

The present invention generally relates to integrated circuit design and layout, and in particular to reference voltage distribution devices and methods.

2. Description of the Related Art

Certain circuit functions common to, for example, high speed serial links and other performance-based integrated systems require accurate voltage references. Typically, a voltage reference provides precision voltages for linear regulators, bias circuits, signal detection circuits, transmitters, and many other circuit functions. Technology limitations for providing quality silicon, as well as the industry trends in reducing reference voltages, create challenges for distributing precision voltage references to cores on a multiple-core integrated circuit (IC). Hence, for example, the ability to use a simple bandgap voltage reference with sufficient accuracy for each core is becoming increasingly more difficult. While trimmable bandgap technologies are well known, implementation of such technology in multiple-core ICs is impractical due to the resources required for the trimming process. Expending such resources for a multiple-core IC is unacceptable unless it is implemented only once per IC and at a central location.

Accurately distributing a precision voltage reference from a central location on an IC to multiple cores is a difficult task. Voltage offsets in the IC's ground grid between two points can reduce the accuracy of the voltage reference when the voltage reference is distributed in a single-ended fashion. Distributing an accurate differential reference on an IC has been investigated; however, the known technology often requires at each core location a differential receiver with multiple amplifier stages to maintain high input impedance. The multiple input offsets of the amplifiers can again reduce the accuracy of the distributed voltage reference.

SUMMARY OF ILLUSTRATIVE EMBODIMENTS

Inventive embodiments described herein provide for, among other things, accurately distributing a voltage reference to multiple cores of an integrated circuit. In one embodiment, a quasi-differential interface is used to transmit the voltage reference, and a virtual ground is established at a receiver located at each core location on the integrated circuit. In some embodiments, the receiver is an operational transconductance amplifier (OTA) that converts a virtual-ground-referenced voltage input to a current output. In one implementation, three driving current sources convert the current output of the OTA into three currents operating relative to the virtual ground and the local ground of the core. Negative feedback controls the accuracy of this conversion and provides a way to cancel the effects of the distribution resistance. The current is sourced across the voltage domains between the virtual ground and the voltage source ($V_{SS}$), which is the integrated circuit (IC) ground. An I*R drop across a resistance converts the current to a voltage referenced to $V_{SS}$ at the output.

In one embodiment, the invention relates to an integrated circuit having multiple cores each requiring a voltage reference. The integrated circuit includes a single point voltage reference source, a differential routing pair coupled to the single point reference source, where the differential routing pair has a first leg and a second leg, and a core coupled to the differential routing pair. The core has an operational transconductance amplifier having a noninverting input, an inverting input, and a current output. The integrated circuit is configured so that the first leg is coupled to the inverting input through a first resistance, and the second leg is coupled to the noninverting input. Additionally, the integrated circuit includes first, second, and third current sources, wherein the first current source is adapted to apply a first current to the first leg, the second current source is adapted to apply a second current to the second leg, and the third current source is adapted to apply a current to a second resistance.

In another embodiment, the invention is directed to a device having a single point voltage reference, a differential interface coupled to the single point reference, at least one core coupled to the differential interface. The core includes an operational transconductance amplifier (OTA) adapted to receive a voltage from the differential interface, at least three current sources configured to be in electrical communication with the OTA, and a resistor coupled to one of the current sources.

Yet another aspect of the invention concerns a method of distributing a reference voltage in an integrated circuit. The method includes the steps of coupling a first leg of a differential routing pair to a noninverting input of an operational transconductance amplifier ("OTA"); coupling a second leg of the differential routing pair to an inverting input of the OTA, wherein the differential routing pair is associated with a voltage reference; and producing a current output via the OTA. The method further includes the step of converting the current output to first, second, and third driving currents via respective first, second, and third current sources; establishing a virtual ground by applying the first driving current to the second leg of the routing pair and applying the second driving current to the first leg of the routing pair; and providing a negative feedback to the OTA by coupling the first driving current to the inverting input of the OTA. The method can also include the step of converting the third driving current to a voltage reference output by applying the third driving current to a resistance.

The above as well as additional features and advantages of the present invention will become apparent in the following detailed written description.

BRIEF DESCRIPTION OF THE DRAWINGS

The invention itself will best be understood by reference to the following detailed description of an illustrative embodiment when read in conjunction with the accompanying drawings, wherein.

DETAILED DESCRIPTION OF AN ILLUSTRATIVE EMBODIMENT

The illustrative embodiments provide methods and devices for accurately distributing a voltage reference to multiple cores of an integrated circuit. A quasi-differential interface is used to transmit the voltage reference, and a virtual ground is established at a receiver located at each core location on the integrated circuit. In one embodiment, the receiver is an operational transconductance amplifier (OTA) that converts a virtual-ground-referenced voltage input to a current. In some implementations, the virtual-ground-referenced voltage is converted into three currents via three driving current sources operating relative to the virtual ground and the local ground of the core. Negative feedback controls the accuracy of this conversion and provides a way to cancel the effects of the distribution resistance. The current is sourced across the voltage domains between the virtual ground and the voltage source ($V_{SS}$), which is the integrated circuit (IC) ground. An I*R drop across a resistor converts the current to a voltage referenced to $V_{SS}$ at the output.

In the following detailed description of exemplary embodiments of the invention, specific exemplary embodiments in which the invention may be practiced are described in sufficient detail to enable those skilled in the art to practice the invention, and it is to be understood that other embodiments may be used and that logical, architectural, programmatic, mechanical, electrical and other changes may be made without departing from the spirit or scope of the present invention. The following detailed description is, therefore, not to be taken in a limiting sense, and the scope of the present invention is defined only by the appended claims.

It is understood that the use of specific component, device and/or parameter names are for example only and not meant to imply any limitations on the invention. The invention may thus be implemented with different nomenclature/terminology used to describe the components/devices/parameters herein, without limitation. Each term used herein is to be given its broadest interpretation given the context in which that terms is used. Specifically, as used herein, the terms integrated circuit, core, amplifier, current source, voltage reference, voltage domain, for example, are to be interpreted as broadly as common in the field of microelectronics.

Figure 1:
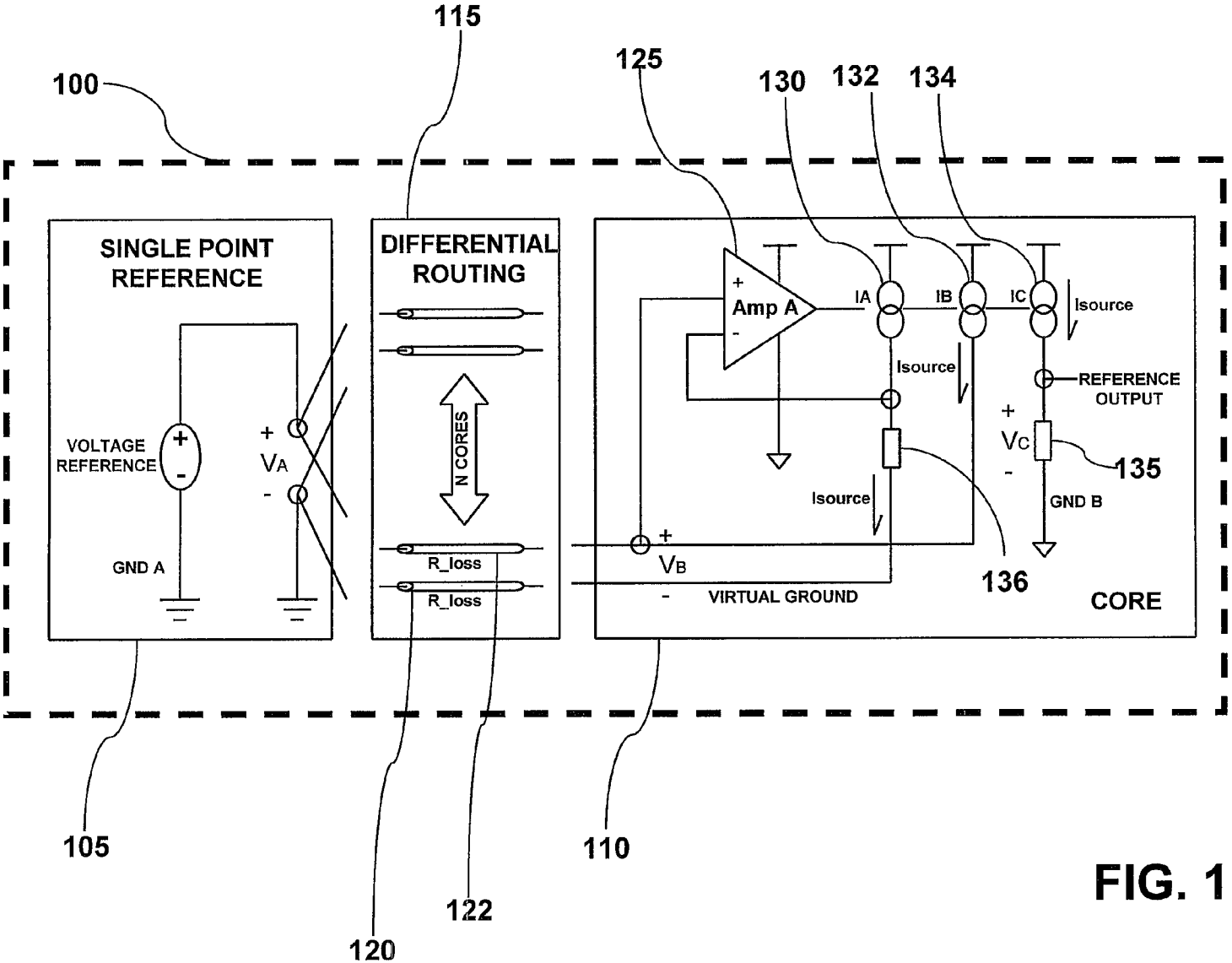
FIG. 1 is a schematic diagram of a voltage reference distribution system configured with hardware and software components for implementing one or more embodiments of the invention.

With reference now to the figures, FIG. 1 depicts a schematic representation of a voltage reference circuit (VRC) 100 that can be implemented on a multiple-core integrated circuit. In one embodiment, VRC 100 includes a single point voltage reference source 105 connected to at least one core 110 via differential routing interface 115. VRC 100 may include multiple (N) cores (although only one core is shown) coupled to voltage reference source 105. Voltage reference source 105 may include a voltage source having a reference to ground A (GND A). VRC 100 can have a potential $V_A$, which is the reference voltage to be distributed to at least one core 110. Differential routing interface 115 is configured to include at least one differential pair per core. Each differential pair includes a first leg 120 and a second leg 122. First leg 120 and second leg 122 are connected to potential $V_A$. First leg 120 and second leg 122 are also connected to core 110. First leg 120 and second leg 122 each have a resistive loss (R_loss) between the potential $V_A$ and the core 110.

In one embodiment, core 110 includes an operational transconductance amplifier ("OTA" or "Amp A") 125 coupled to a first current source ($I_A$) 130, a second current source ($I_B$) 132, and a third current source ($I_C$) 134. The magnitude of each current source is equal (for convenience, referenced here as $I_{source}$). First leg 120 couples to the inverting input of OTA 125 through resistor 136, and is further coupled to current source $I_A$ 130. Second leg 122 couples to noninverting input of OTA 125 and is further coupled to current source $I_B$ 132. Current flow ($I_{source}$) through first leg 120, having a resistance of R_loss, creates a voltage drop across first leg 120 equal to R_loss*$I_{source}$. Likewise, current flow ($I_{source}$) through second leg 122, having a resistance of R_loss, creates a voltage drop across second leg 122 equal to R_loss*$I_{source}$. Since the voltage drop across each of first leg 120 and second leg 122 is identical (that is, R_loss*$I_{source}$), the resistive voltage drop inherently and ordinarily arising from the routing of the differential pair from voltage reference source 105 to virtual ground of core 110 is canceled. Hence, under this configuration of VRC 100, potential $V_B$ is equal to potential $V_A$.

By coupling first leg 120 and second leg 122 to the OTA 125 in the manner described, and by providing a negative feedback loop with OTA 125, a differential voltage potential $V_B$ is established between first leg 120 and second leg 122. Voltage potential $V_B$ is equal in magnitude to the voltage reference $V_A$. The common mode rejection of OTA 125 prevents an error in the current $I_{source}$ due to any difference in potentials between the ground reference GND A in reference source 105 and virtual ground in core 110.

In one embodiment, core 110 includes a resistor 135 coupled to current source $I_C$ 134 and to the local ground GND B of core 110. Current produced by current source $I_C$ 134, having magnitude equal to $I_{source}$, is passed through resistor 135 to produce output voltage $V_C$, which is an output voltage referenced to the local ground GND B of core 110 and is equal in magnitude to supplied voltage reference $V_A$. The magnitudes of resistor 135, resistor 136, and $I_{source}$ are suitably selected to ensure that $V_C$ is of equal magnitude to $V_A$. Hence, by providing each core of an integrated circuit with the circuitry described here, multiple voltage reference circuits 100 can be configured to distribute accurately a reference voltage from reference voltage source 105 to multiple cores 110 in an integrated circuit.

In the described embodiment, VRC 100 can be a component of a high speed serial link or other performance based integrated circuits. VRC 100 can be used to supply accurate reference voltages for linear regulators, bias circuits, signal detection circuits, transmitters, and many other circuit functions. Those of ordinary skill in the art will appreciate that the schematic of hardware depicted in FIG. 1 is a basic illustration of a voltage reference circuit, and thus the hardware used in actual implementation may vary. Thus, the depicted example is not meant to imply architectural limitations with respect to the present invention.

Figure 2:
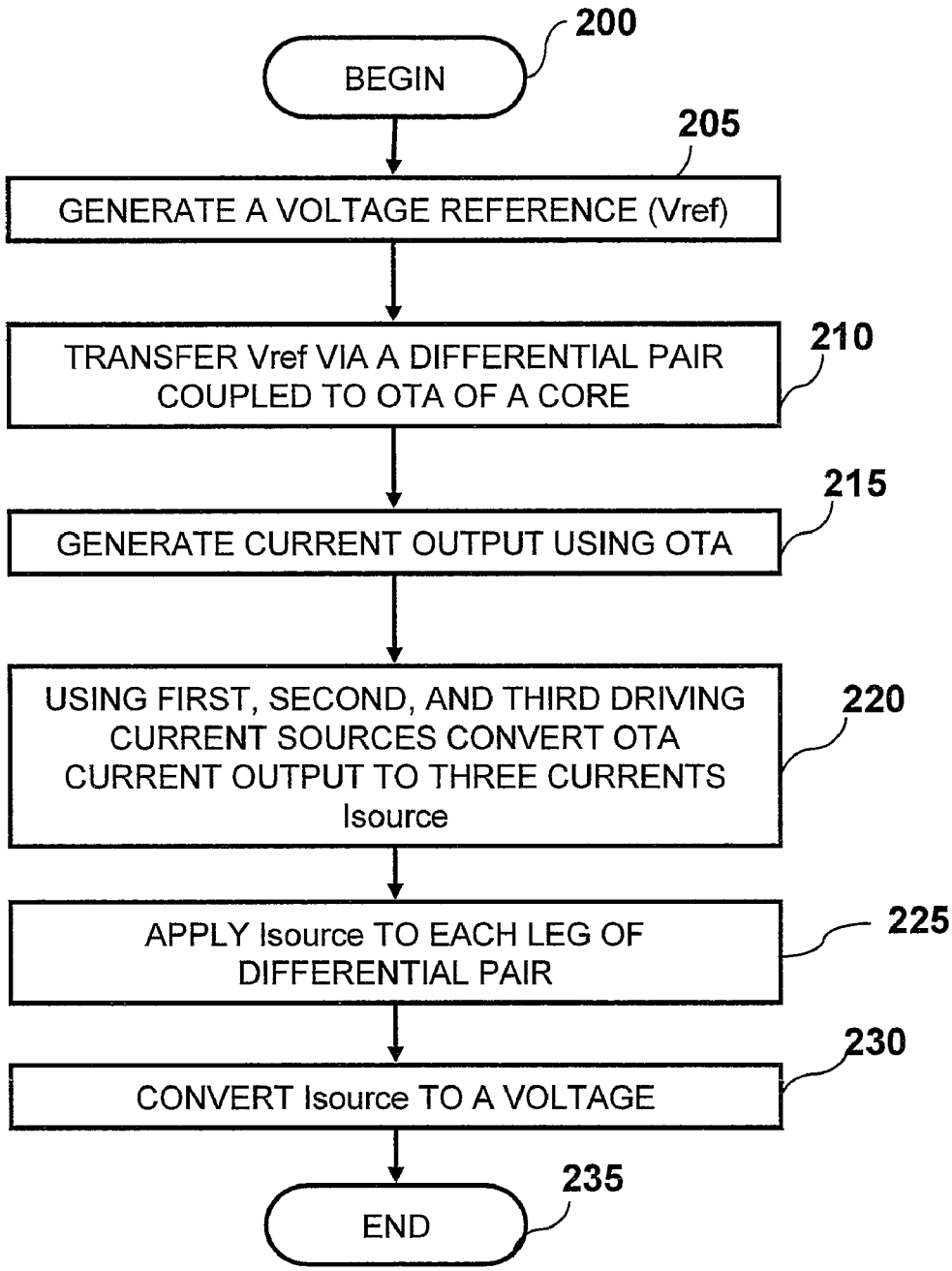
FIG. 2 is a flow chart of a process by which certain features of the invention are implemented according to one embodiment of the invention.

Referring now to FIG. 2, wherein is shown a flow chart illustrating an exemplary method of distributing a voltage reference in a multi-core integrated circuit. Although the method of FIG. 2 may be described with reference to components shown in FIG. 1, it should be understood that this is merely for convenience and alternative components and/or configurations thereof can be employed when implementing the various methods.

The process of FIG. 2 begins at initiator block 200 and proceeds to block 205, at which a voltage reference is generated. In one embodiment, the voltage reference may have a ground (GND A) and potential $V_A$. The process passes to block 210, where the voltage reference is transferred as a differential pair to a core, for example core 110. Next, at block 215, a current output is produced by, for example, using the OTA 125 configured as described above with reference to FIG. 1 (that is, the first leg 122 of the differential pair is coupled to the noninverting input of OTA 125 and the second leg of the differential pair is coupled to the inverting input of OTA 125). In one embodiment, OTA 125 generates a current output with respect to a virtual ground. At block 220, the current output is converted to a number of driving currents having a magnitude of $I_{source}$ via first, second, and third current sources ($I_A$ 130, $I_B$ 132, and $I_C$ 134, for example). The process continues to block 225 where current $I_{source}$ is passed through each of the legs of the differential pair (for example, first leg 120 and second leg 122). At block 230, $I_{source}$ is converted to an output voltage with respect to the core ground, which output voltage is equal in magnitude to the voltage reference generated at block 205. The process terminates at block 235.

In the flow charts above, one or more of the methods are embodied in a computer readable medium containing computer readable code such that a series of steps are performed when the computer readable code is executed on a computing device. In some implementations, certain steps of the methods are combined, performed simultaneously or in a different order, or perhaps omitted, without deviating from the spirit and scope of the invention. Thus, while the method steps are described and illustrated in a particular sequence, use of a specific sequence of steps is not meant to imply any limitations on the invention. Changes may be made with regards to the sequence of steps without departing from the spirit or scope of the present invention. Use of a particular sequence is therefore, not to be taken in a limiting sense, and the scope of the present invention is defined only by the appended claims.

As will be further appreciated, the processes in embodiments of the present invention may be implemented using any combination of software, firmware or hardware. The methods of the invention may be practiced by combining one or more machine-readable storage devices containing the code according to the present invention with appropriate processing hardware to execute the code contained therein. An apparatus for practicing the invention could be one or more processing devices and storage systems containing or having network access to program(s) coded in accordance with the invention.

While the invention has been described with reference to exemplary embodiments, it will be understood by those skilled in the art that various changes may be made and equivalents may be substituted for elements thereof without departing from the scope of the invention. In addition, many modifications may be made to adapt a particular system, device or component thereof to the teachings of the invention without departing from the essential scope thereof. Therefore, it is intended that the invention not be limited to the particular embodiments disclosed for carrying out this invention, but that the invention will include all embodiments falling within the scope of the appended claims. Moreover, the use of the terms first, second, etc. do not denote any order or importance, but rather the terms first, second, etc. are used to distinguish one element from another.

What is claimed is:

1. An integrated circuit having multiple cores each requiring a voltage reference, the integrated circuit comprising:

a single point voltage reference source;

a differential routing pair coupled to the single point reference source, the differential routing pair having a first leg and a second leg; and a core coupled to the differential routing pair, the core comprising:

an operational transconductance amplifier having a noninverting input, an inverting input, and a current output;

wherein the first leg is coupled to the inverting input through a first resistance, and the second leg is coupled to the noninverting input; and first, second, and third current sources, wherein the first current source is adapted to apply a first current to the first leg, the second current source is adapted to apply a second current to the second leg, and the third current source is adapted to apply a current to a second resistance.

2. The integrated circuit of claim 1, wherein the single point voltage reference has a first ground reference and wherein the core has a second ground reference.

3. The integrated circuit of claim 1, wherein the second resistance is selected such that a voltage produced by applying the third current source to the second resistance is equal to the voltage reference of the single point voltage reference source.

4. A device comprising:

a single point voltage reference;

a differential interface coupled to the single point reference;

at least one core coupled to the differential interface, the core comprising:

an operational transconductance amplifier (OTA) adapted to receive a voltage from the differential interface;

at least three current sources configured to be in electrical communication with the OTA; and a resistor coupled to one of said current sources.

5. The device of claim 4, wherein the differential interface comprises a plurality of differential routing pairs.

6. The device of claim 4, wherein the three current sources are of equal magnitude relative to each other.

7. The device of claim 4, wherein the resistor is selected such that a current applied to the resistor produces a voltage of equal magnitude to a voltage reference of the single point voltage reference.

8. A method of distributing a reference voltage in an integrated circuit having multiple cores, the method comprising:

providing, via a differential routing pair, a voltage differential associated with a voltage reference to an operational transconductance amplifier ("OTA"), wherein a first leg of the differential routing pair is coupled to a noninverting input of the OTA, and wherein a second leg of the differential routing pair is coupled to an inverting input of the OTA;

producing a current output via the OTA;

converting the current output to first, second, and third driving currents via respective first, second, and third current sources;

establishing a virtual ground by applying the first driving current to the second leg of the differential routing pair and applying the second driving current to the first leg of the differential routing pair;

providing a negative feedback to the OTA by coupling the first driving current to the inverting input of the OTA and applying the first driving current to a first resistance coupled to the OTA; and converting the third driving current to a voltage by applying the third driving current to a second resistance thereby generating a voltage output equal in magnitude to the voltage reference.

9. The method of claim 8, wherein converting the current output comprises converting the current output to first, second, and third driving currents of equal magnitude.

10. The method of claim 9, wherein a magnitude of each the first, second, and third driving currents is selected such that said voltage output is equal in magnitude to said voltage reference.

* * * * *